US008087847B2

(12) United States Patent
Scott

(10) Patent No.: US 8,087,847 B2
(45) Date of Patent: Jan. 3, 2012

(54) WIRELESS TIRE DEFLATION DEVICE LAUNCHER

(76) Inventor: Robert L. Scott, Rio Rico, AZ (US)

( * ) Notice: Subject to any disclaimer, the term of this patent is extended or adjusted under 35 U.S.C. 154(b) by 0 days.

(21) Appl. No.: 13/050,874

(22) Filed: Mar. 17, 2011

(65) Prior Publication Data

US 2011/0229260 A1 Sep. 22, 2011

Related U.S. Application Data

(60) Provisional application No. 61/314,808, filed on Mar. 17, 2010.

(51) Int. Cl.
*E01F 13/12* (2006.01)

(52) U.S. Cl. ..... 404/6; 404/83; 124/1

(58) Field of Classification Search ..... 89/1.1, 89/1.815; 404/6, 83; 124/1, 16; 180/287
See application file for complete search history.

(56) References Cited

U.S. PATENT DOCUMENTS

| | | | | |
|---|---|---|---|---|
| 5,415,246 | A * | 5/1995 | Cooper | 180/287 |
| 5,611,408 | A * | 3/1997 | Abukhader | 180/287 |
| 5,839,849 | A * | 11/1998 | Pacholok et al. | 404/6 |
| 6,176,519 | B1 * | 1/2001 | Limingoja | 280/762 |
| 6,527,475 | B1 * | 3/2003 | Lowrie | 404/6 |
| 6,623,205 | B1 * | 9/2003 | Ramirez | 404/6 |
| 6,869,248 | B1 * | 3/2005 | Threlkeld | 404/6 |
| 7,220,076 | B2 * | 5/2007 | Boll | 404/6 |
| 7,246,613 | B1 * | 7/2007 | Mohar | 124/57 |
| 7,275,889 | B1 * | 10/2007 | McGill | 404/6 |
| 7,377,715 | B2 * | 5/2008 | Kruise | 404/6 |
| 7,412,321 | B2 * | 8/2008 | de Sylva | 701/101 |
| 7,573,379 | B2 * | 8/2009 | Moormeier et al. | 340/500 |

* cited by examiner

*Primary Examiner* — Gary S Hartmann
(74) *Attorney, Agent, or Firm* — Sinorica, LLC

(57) ABSTRACT

The present invention is an apparatus used to launch a tire deflation device into the path of a fleeing vehicle. The present invention makes use of a guide frame to support and guide the tire deflation device towards the intended destination. The energy storing mechanism stores the energy required to launch the tire deflation device. The push train delivers the energy to the tire deflation device. The launching of the tire deflation device is triggered by a wireless remote system, otherwise known as the wireless trigger mechanism.

19 Claims, 7 Drawing Sheets

WIRELESS TIRE DEFLATION DEVICE LAUNCHER

The current application claims a priority to the U.S. Provisional Patent application Ser. No. 61/314,808 filed on Mar. 17, 2010.

FIELD OF THE INVENTION

The present invention relates generally to a device that is able to launch a tire deflation device. The objective of the present invention is to launch a tire deflation device in front of a pursuit vehicle and disable the pursuit vehicle without the use of multiple police officers.

BACKGROUND OF THE INVENTION

Traditionally, at many law enforcement and Homeland Security checkpoints, tire deflation devices such as "Stop Sticks" are deployed manually by an additional officer to disable fleeing vehicles and prevent dangerous vehicle pursuits. In applications such as Border Patrol traffic checkpoints and International Ports of Entry, the additional officer is often pre-positioned to manually deploy a controlled tire deflation device in the event a vehicle attempts to flee the checkpoint. Three to four tire deflation devices in a flexible sleeve are thrown into the path of the fleeing vehicle by the additional officer. The present invention eliminates the need to have additional officers deploy the tire deflation device to disable the fleeing vehicle. The present invention will allow a single officer to remotely deploy the tire deflation device, up to 12 feet in length, in a timely manner by a signal from a wireless transmitter that can be worn by the officer.

The benefits of the present invention over other similar inventions is that the present invention leaves the roadway completely clear of any obstructions until the tire deflation device is actually deployed. Additionally, the present invention leaves the officer's hands unoccupied, which increases the officer's safety and potentially saves countless man-hours that can be used for other law enforcement activities. The human error of inadvertently deploying tire deflation devices in front of the wrong vehicle is reduced because confusion or poor communication between the checkpoint officer and the addition officer will no longer be a factor.

DETAIL DESCRIPTIONS OF THE INVENTION

Figure 1:
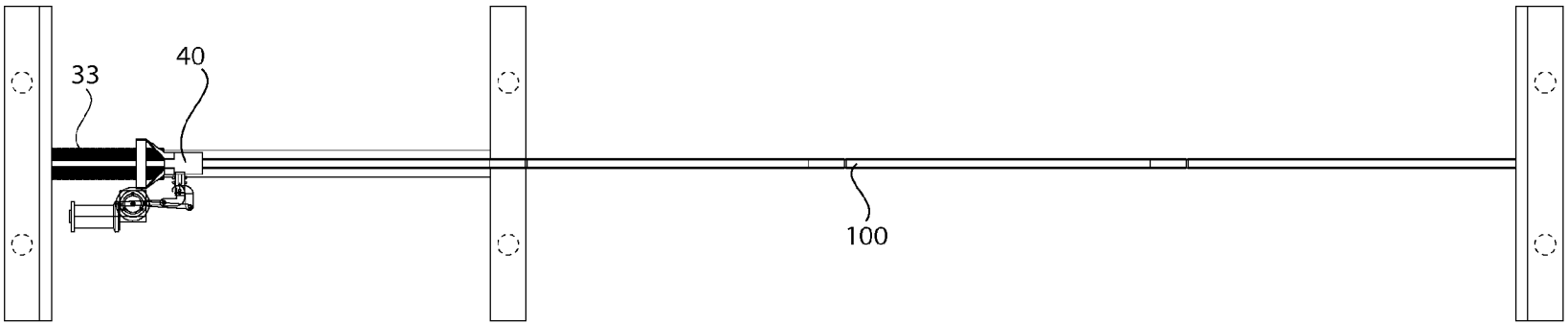
FIG. 1 is a top view of the entire apparatus.
Figure 2:
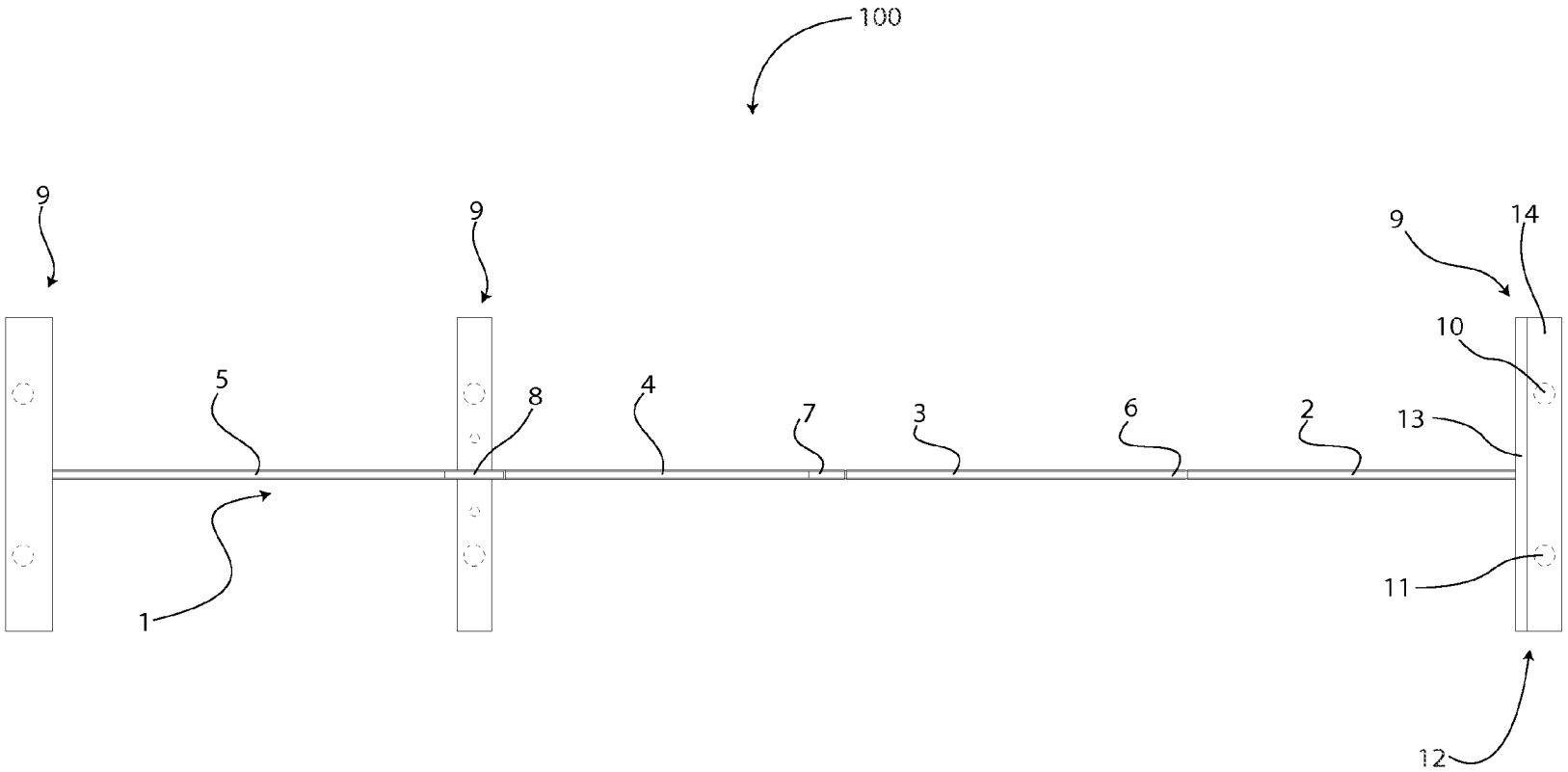
FIG. 2 is a top view of the guide frame.
Figure 3:
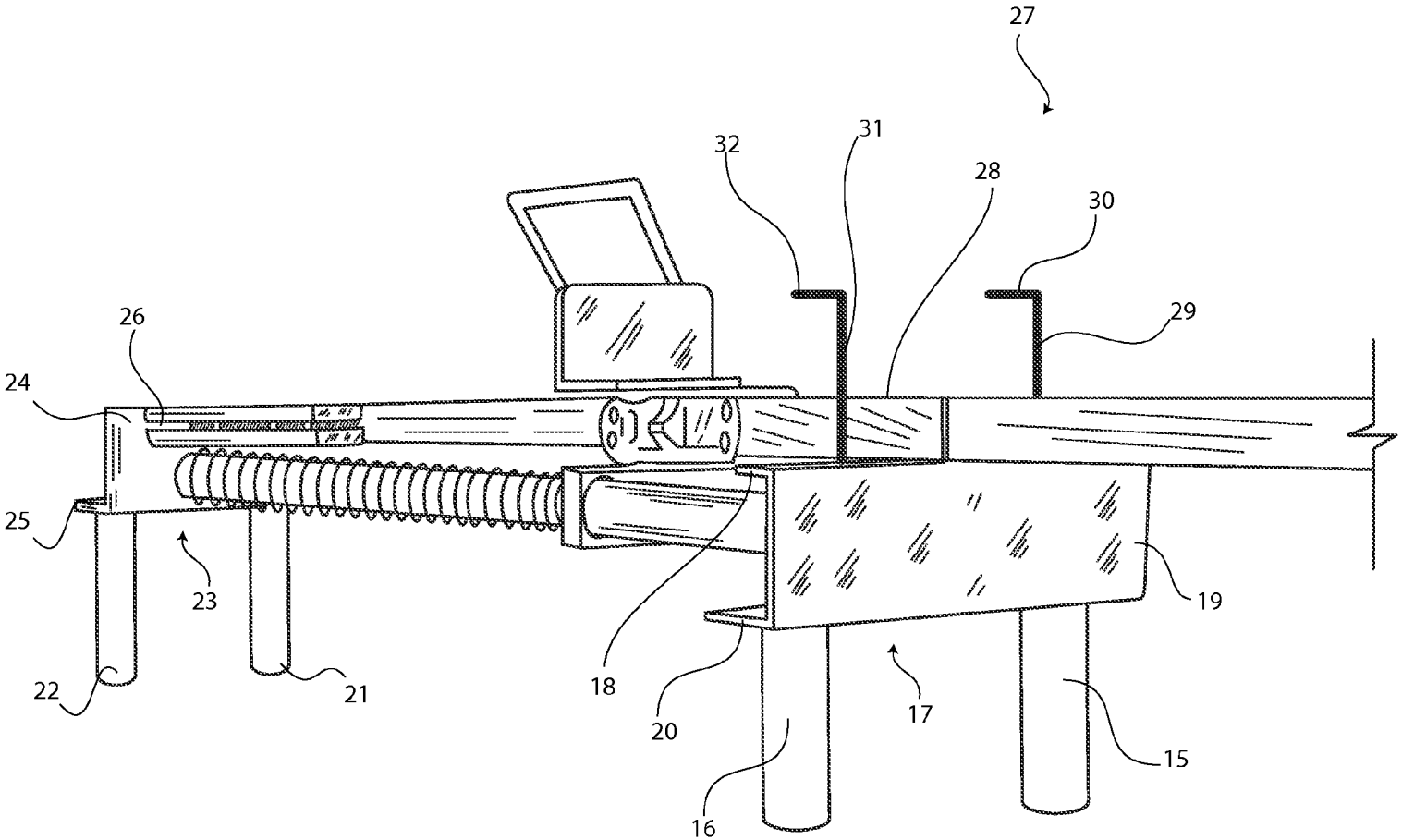
FIG. 3 is a perspective view of the fourth rail.
Figure 4:
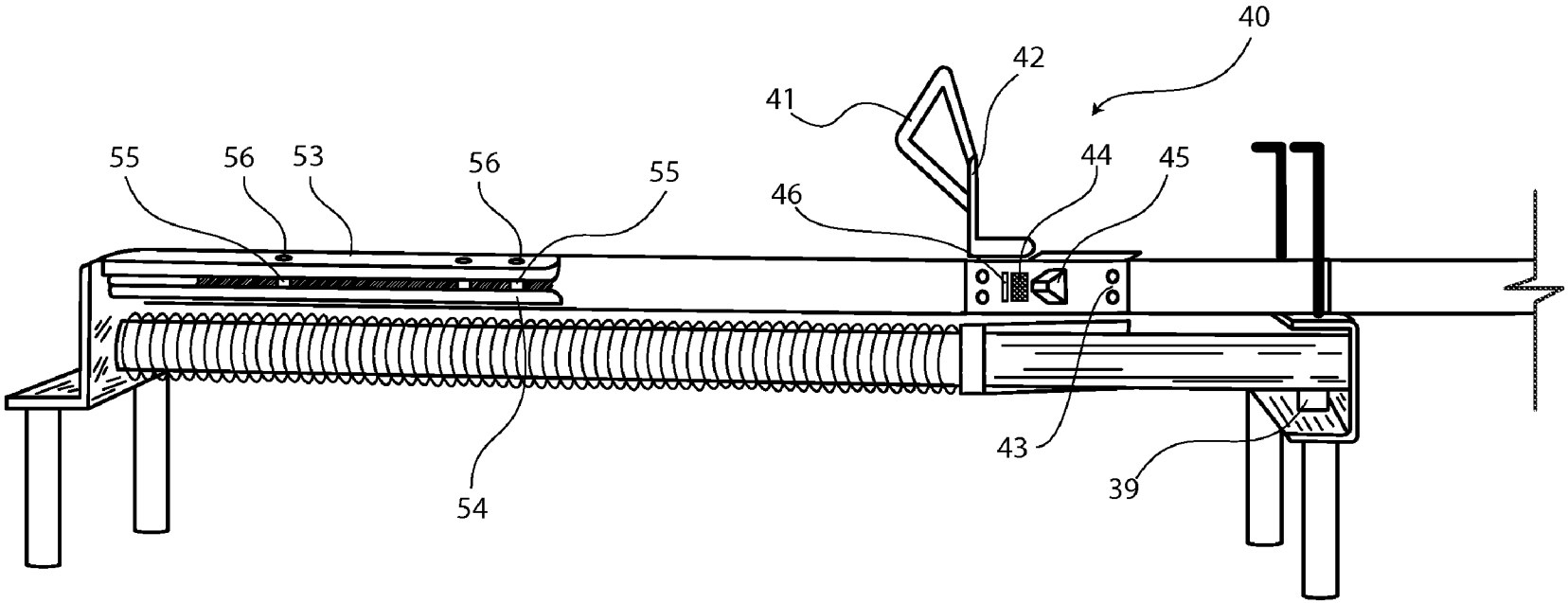
FIG. 4 is a side view of the fourth rail.
Figure 5:
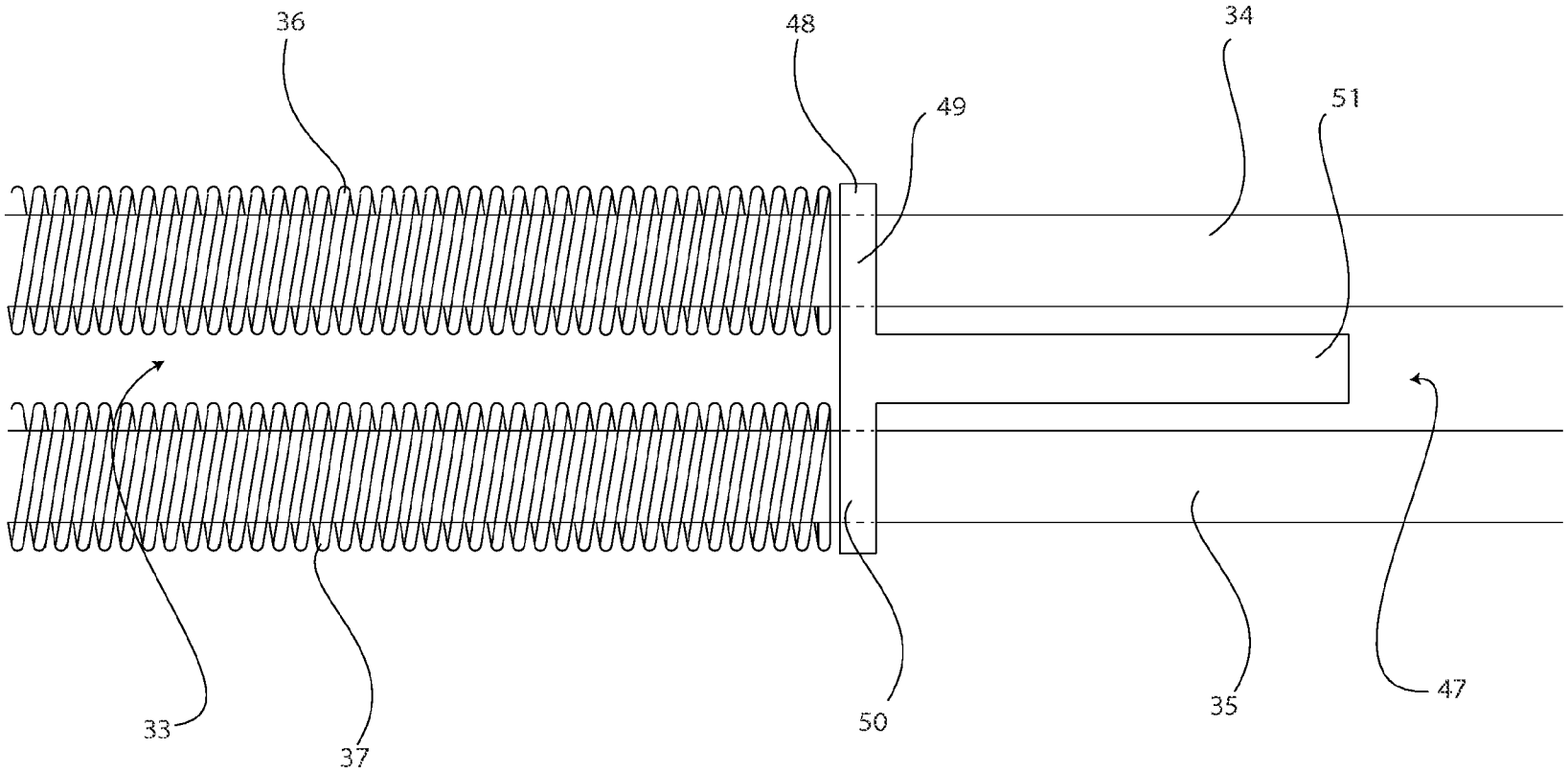
FIG. 5 is a magnified view of the bottom of the push train and the energy storing mechanism.
Figure 6:
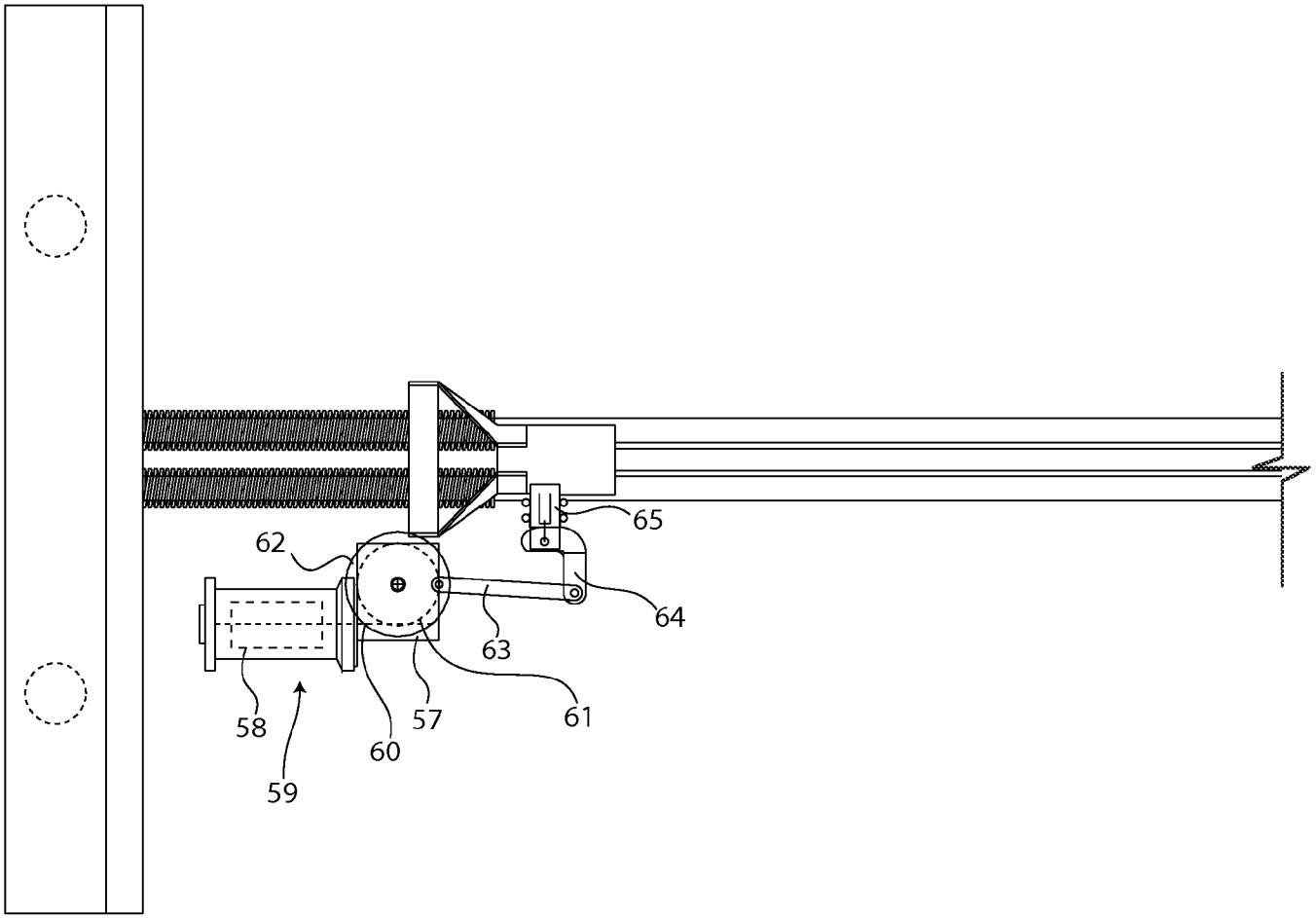
FIG. 6 is the wireless trigger mechanism is the locked position with the push train.
Figure 7:
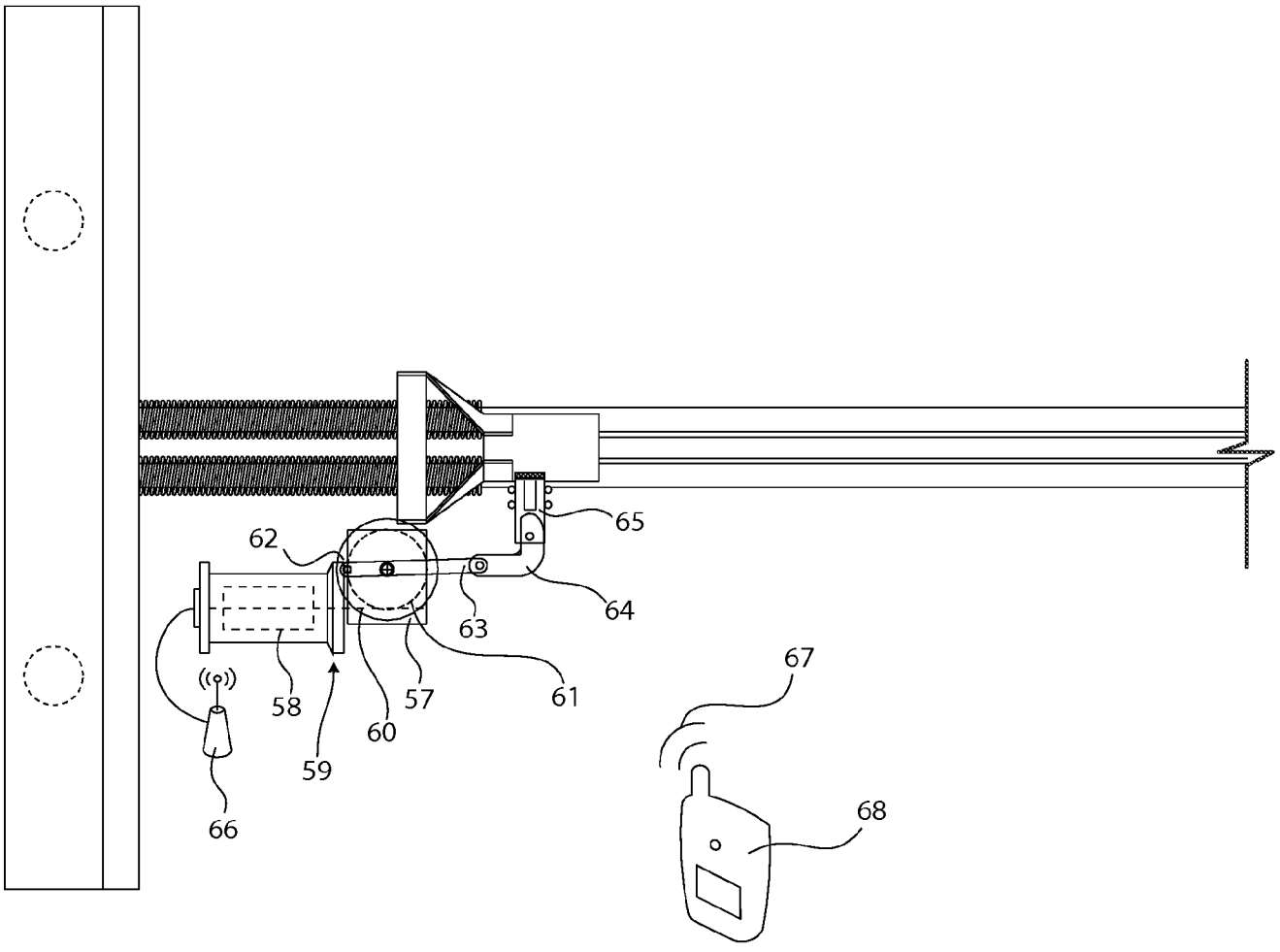
FIG. 7 is the wireless trigger mechanism in the unlocked position with the push train.

All illustrations of the drawings are for the purpose of describing selected versions of the present invention and are not intended to limit the scope of the present invention.

The wireless tire deflation device launcher is an apparatus used to remotely shoot a tire deflation device, such as a "Stop Stick", into the path of an escaping vehicle. The apparatus is constituted of four major components: a guide frame 100, an energy storing mechanism 33, a push train 40, and a wireless trigger mechanism 52. The guide frame 100 provides the apparatus with a structure and guides the tire deflation device towards the intended destination. The energy storing mechanism 33 provides the energy required to launch the tire deflation device. The preferred embodiment of the energy storing mechanism 33 is a loaded spring system but other embodiments of the energy storing mechanism 33 involve a compressed air piston, an elastic material, or an explosive charge. The push train 40 is the vehicle that delivers the stored energy as kinetic energy to the tire deflation device and pushes the "Stop Stick" along the guide frame 100. The wireless trigger mechanism 52 locks the push train 40 in place and unlocks the push train 40 when the tire deflation device needs to be launched.

The guide frame 100 comprises a guide rail 1, a guide support 9, and a tire deflation device support 27. The guide rail 1 is the longest component on the guide frame 100 and provides a base for all other components of the guide frame 100 to attach themselves. The guide rail 1 consists of a first rail 2, a second rail 3, a third rail 4, a fourth rail 5, a first connection 6, a second connection 7, and a third connection 8. The first rail 2 is the front of the guide rail 1. The second rail 3 and the third rail 4 is the middle of the guide rail 1. The fourth rail 5 is the back of the guide rail 1. The first rail 2, the second rail 3, the third rail 4 and the fourth rail 5 are square tubes. The first rail 2, the second rail 3, the third rail 4, and the fourth rail 5 are connected in a linear manner. The first connection 6 attaches the back of the first rail 2 to the front of the second rail 3. The second connection 7 attaches the back of the second rail 3 to the front of the third rail 4. The third connection 8 attaches the back of the third rail 4 to the front of the fourth rail 5. The first connection 6, the second connection 7, and the third connection 8 are readily detachable, which allows the user to easily store and quickly assembly the apparatus.

The guide support 9 provides a foundation for the apparatus and is located on the guide frame 100. The guide support 9 consist of a front left support 10, a front right support 11, a front support connection beam 12, a middle left support 15, a middle right support 16, a middle support connection beam 17, a back left support 21, a back right support 22, and a back support connection beam 23. The front left support 10 and the front right support 11 hold up the front of the apparatus. The middle left support 15 and the middle right support 16 hold up the middle the apparatus. The back left support 21 and the back right support 22 hold up the back of the apparatus. The front left support 10, the front right support 11, the middle left support 15, the middle right support 16, the back left support 21, and the back right support 22 are rods of equal length, which are normal to the plane of the ground. The front left support 10, the front right support 11, the middle left support 15, the middle right support 16, the back left support 21, and the back right support 22 allow the apparatus to launch the tire deflation device at the proper height off the ground; otherwise the tire deflation device might not reach the desired horizontal distance. The front support connection beam 12 is an L-beam and comprises of a front perpendicular leg 13 and a front parallel leg 14. The front perpendicular leg 13 is the leg of the front support connection beam 12 that is perpendicular to the plane of the ground. The front parallel leg 14 is the leg of the front support connection beam 12 that is parallel to the plane of the ground. The left side of the front parallel leg 14 is adhered perpendicularly to the top of the front left support 10. The right side of the front parallel leg 14 is adhered perpendicularly to the top of the front right support 11. The middle support connection beam 17 is a square channel and comprises of a top flange 18, a middle web 19, and a bottom flange 20. The left side of the bottom flange 20 is adhered perpendicularly to the top of the middle left support 15. The right side of the bottom flange 20 is adhered perpendicularly to the top of the middle right support 16. The back support connection beam 23 is an L-beam and comprises of a back perpendicular leg 24 and a back parallel leg 25. The back perpendicular leg 24 is the leg of the back support connection beam 23 that is perpendicular to the plane of the ground. The back parallel leg 25 is the plane of the back support connection beam 23 that is parallel to the plane of the ground. The left side of the back parallel leg 25 is adhered perpendicularly to the top of the back left support 21. The right side of the back parallel leg 25 is adhered perpendicularly to the top of the back right support 22. The front support connection beam 12, the middle support connection beam 17, and the back support connection beam 23 position the front left support 10, the middle left support 15, and the back left support 21 a proper distance away from the front right support 11, the middle right support 16, and the back right support 22 in order to create a wide standing for the apparatus. The center of the front perpendicular leg 13 is attached to the front lateral side of the first rail 2. The center of the top flange 18 is attached to the bottom of the third connection 8. The center of the back perpendicular leg 24 is attached to the back lateral side of the fourth rail 5.

The device support 27 allows the guide frame 100 to support the tire deflation device both pre-launch and during the launch. The device support 27 consist of a device surface 28, a device left arm 29, a device left hand 30, a device right arm 31, and a device right hand 32. The device surface 28 is the top surface of the guide rail 1. The device surface 28 guides and supports the tire deflation device from the bottom. The device left hand 30 is a rod lies above and parallel to the left side of the guide rail 1. The device left hand 30 guides and supports the tire deflation device from the left. The device left arm 29 is a rod normal to the plane of the ground. The top of the device left arm 29 is attached to the device left hand 30 and holds the device left hand 30 at the proper vertical position. The device right hand 32 is a rod lies above and parallel to the right side of the guide rail 1. The device right hand 32 guides and supports the tire deflation device from the right. The device right arm 31 is a rod normal to the plane of the ground. The top of the device right arm 31 is attached to the device right hand 32 and holds the device right hand 32 at the proper vertical position. The bottom of the device left arm 29 is connected to left side of the top flange 18, and the bottom of the device right arm 31 is connected to the right side of the top flange 18. The device left arm 29 and the device right arm 31 are attached at the proper width on the top flange 18 so that the device left hand 30 and the device right hand 32 can adequately support the tire deflation device from the left and from right. If the width between the device left arm 29 and the device right arm 31 is too small, then the tire deflation device will experience too much friction from the device left hand 30 and the device right hand 32 during the launch. If the width between the device left arm 29 and the device right arm 31 is too large, the tire deflation device might not stay on center during the launch.

The energy storing mechanism 33 provides the energy required by the apparatus to launch the tire deflation device the desired horizontal distance away. In the preferred embodiment, the energy storing mechanism 33 uses a loaded spring system and comprises of a left spring 36, a left spring rod 34, a right spring 37, a right spring rod 35, and a forward stop cushion 39. The left spring rod 34 lies parallel and below the guide rail 1. The front end of the left spring rod 34 is connected to the left side of the middle web 19, and the back of the left spring rod 34 is attached to the left side of the back perpendicular leg 24. The left spring 36 encloses the lateral surface of the left spring rod 34. The right spring rod 35 lies parallel and below the guide rail 1. The front end of the right spring rod 35 is connected to the right side of the middle web 19, and the back end of the right spring rod 35 is connected to the right side of the back perpendicular leg 24. The right spring 37 encloses the lateral surface of the right spring rod 35. The left spring rod 34 and the right spring rod 35 guide the compression and expansion of the left spring 36 and the right spring 37. As the push train 40 is pulled towards the back of the guide rail 1, the left spring 36 and the right spring 37 are compressed and store spring potential energy. When the push train 40 is locked by the trigger mechanism, the energy storing mechanism 33 has the required amount of spring potential energy to launch the tire deflation device to the desired horizontal direction. When the trigger mechanism releases the push train 40, the left spring 36 and the right spring 37 expand and the set amount of spring potential energy changes into kinetic energy as the push train 40 moves forward along the length of the guide rail 1. The push train 40 transfers the set amount of kinetic energy into the tire deflation device, which launches the tire deflation device forward to the desired horizontal distance away. The forward stop cushion 39 prevents the push train 40 from going too far forward and sliding off the guide rail 1. The forward stop cushion 39 is located at the center of the middle support connection beam 17 in between the top flange 18 and the bottom flange 20. The forward stop cushion 39 is made of a shock absorbing material, which slows the forward motion of the push train 40 to a stop; otherwise the push train 40 will clang against the middle support connection beam 17 and damage the apparatus from the recoil.

The push train 40 comprises of a seat 42, a handle 41, a rail housing 43, a trigger cavity 44, a backward stop protrusion 45, a ramp protrusion 46, and a T-beam 47. The rail housing 43 is a square tube that encircles the guide rail 1. The rail housing 43 allows the push train 40 to follow the path laid out by the guide rail 1. The seat 42 is placed on top side of the rail housing 43 and allows the push train 40 to push the tire deflation device from the back. The handle 41 is attached to the seat 42 and allows the user to pull the push train 40 back along the guide rail 1, until the wireless trigger mechanism 52 locks the push train 40 in place. The trigger cavity 44 is located on the right side of the rail housing 43 and allows the wireless trigger mechanism 52 engage the push train 40. The ramp protrusion 46 is located behind the trigger cavity 44 and guides the wireless trigger mechanism 52 into the trigger cavity 44. The backward stop protrusion 45 is located in front of the trigger cavity 44 and stops the push train 40 from sliding too far backward and falling off the guide rail 1. The T-beam 47 has a relatively small length. T-shaped cross section of the T-beam 47 is in a plane parallel to the plane of the ground, and, thus, the top of the T-beam 47 is attached to the bottom side of the rail housing 43. The T-beam 47 consists of a front web 51, a back flange 48, a left spring rod hole 49 and a right spring rod hole 50. The front web 51 travels in between the left spring rod 34 and the right spring rod 35 and stabilizes the push train 40 along its path with use of the left spring rod 34 and the right spring rod 35. In addition, the front web 51 is the component of the push train 40 that hits the forward stop cushion 39. The back flange 48 is perpendicular to the guide rail 1. The back flange 48 has the left spring rod hole 49, in which the left spring rod 34 goes through the back flange 48, and a right spring rod hole 50, in which the right spring rod 35 goes through the back flange 48. The left spring rod hole 49 and the right spring rod hole 50 are small enough only to let the left spring rod 34 and the right spring rod 35 go through the back flange 48 so that the front of the left spring 36 and the front of the right spring 37 rest on the back flange 48.

The wireless trigger mechanism 52 allows the user to lock the push train 40 in place and remotely launch the tire deflation device. The wireless trigger mechanism 52 comprises of a trigger protrusion 26, a top panel 53, a bottom panel 54, a plurality of fasteners 56, a plurality of spacers 55, a motor base 57, a motor 58, a motor housing 59, a worm gear 60, a reduction gear 61, a rotator plate 62, an extension arm 63, a cam 64, a spring loaded lock 65, a radio receiver 66, a radio signal 67, and a remote 68. The trigger protrusion 26 is to the left and parallel to the guide rail 1 and is adhered to the guide rail 1. The top panel 53 and the bottom panel 54 sandwich the trigger protrusion 26 and is held together with the plurality of fasteners 56. The space created by the trigger protrusion 26 between the top panel 53 and the bottom panel 54 is maintained throughout the entire length of the top panel 53 and the bottom panel 54 by the plurality of spacers 55 and the plurality of fasteners 56. The motor base 57 is a smaller panel perpendicularly attached to the bottom panel 54 by the plurality of fasteners 56. The motor 58 spins on a center axis parallel to the guide rail 1. The motor 58 is attached to the worm gear 60 and rotates the worm gear 60 on the same center axis. The worm gear 60 engages the reduction gear 61 and rotates the reduction gear 61 on a center axis which is normal to the plane of the ground. The motor 58, the worm gear 60, and the reduction gear 61 are all enclosed in the motor housing 59, which is attached to the motor base 57 by a plurality of fasteners 56. The reduction gear 61 is attached to the rotator plate 62, which is a circular plate. Thus, the rotator spins on the same center axis that the reduction gear 61 spins on. The extension arm 63 is a flat rod and is jointly attached to the outer portion of the rotator plate 62 at one end. The cam 64 is jointly attached to the other end of the extension arm 63. The cam 64 is an L-shaped object that has one leg jointly attached to the extension arm 63 and the other leg jointly attached to the spring loaded lock 65. The spring loaded lock 65 is a small rectangular block, which is spring loaded to keep the rectangular block in the locked position. The spring loaded lock 65 is located in between the top panel 53 and the bottom panel 54. When the pull train is pulled back along the guide rail 1, the spring loaded lock 65 slides up the ramp protrusion 46 and out of the locked position, until the spring loaded lock 65 falls into the trigger cavity 44. In order to release the spring loaded lock 65, the extension arm 63 carries the rotational motion of the rotator plate 62 to cam 64. The cam 64 changes the rotational motion into linear motion perpendicular to the guide rail 1. The spring loaded lock 65 uses the linear motion to move out the trigger cavity 44 and release the push train 40. The remote 68 allows the user to send a radio signal 67 to the radio receiver 66, which is located on the apparatus. The radio signal 67 will indicate to the radio receiver 66 to spin the motor 58 until the spring loaded lock 65 releases the push train 40.

Although the invention has been explained in relation to its preferred embodiment, it is to be understood that many other possible modifications and variations can be made without departing from the spirit and scope of the invention as hereinafter claimed.

What is claimed is:

1. A wireless tire deflation device launcher comprises of, a guide frame;

an energy storing mechanism;

a push train;

a wireless trigger mechanism;

said guide frame comprises of a guide rail, a guide support, and a device support;

said energy storing mechanism consists of a left spring rod, a left spring, a right spring rod, a right spring, and a forward stop cushion;

said push train comprises of a handle, a seat, a rail housing, a backward stop protrusion, a ramp protrusion, and a T-beam;

said T-beam comprises of a back flange, a left spring rod hole, a right spring rod hole, and a front web; and said wireless trigger mechanism comprises of a trigger protrusion, a top panel, a bottom panel, a plurality of spacers, a plurality of fasteners, a motor base, a motor housing, a motor, a worm gear, a reduction gear, a rotator plate, an extension arm, a cam, a spring loaded lock, a radio receiver, a radio signal, and a remote.

2. Said wireless tire deflation device launcher as claimed in claim 1 comprises of, said guide rail comprises of a first rail, a second rail, a third rail, a fourth rail, a first connection, a second connection, and a third connection;

said guide support comprises of a front left support, a front right support, a front support connection beam, a middle left support, a middle right support, a middle support connection beam, a back left support, a back right support, and a back support connection beam;

said device support comprises of a device surface, a device left arm, a device left hand, a device right arm, and a device right hand;

said first rail being attached to said second rail by said first connection;

said second rail being attached to said third rail by said second connection;

said third rail being attached to said fourth rail by said third connection;

said front left support and said front right support being connected to said first rail by said front support connection beam;

said middle left support and said middle right support being connected to said third connection by said middle support connection beam;

said back left support and said back right support being connected to said fourth rail by said back support connection beam;

said device left arm being attached to said middle support connection beam;

said device right arm being attached to said middle support connection beam;

said device left hand being connected to said device left arm; and said device right hand being connected to said device right arm.

3. Said wireless tire deflation device launcher as claimed in claim 2 comprises of, said front support connection beam comprises of a front perpendicular leg and a front parallel leg;

said middle support connection beam comprises of a top flange, a middle web, and a bottom flange;

said back support connection beam comprises of a back perpendicular leg and a back parallel leg;

said front perpendicular leg being attached to said first rail;

said front left support and said front right support being attached to said front parallel leg;

said top flange being attached to said third connection;

said middle left support and said middle right support being attached to said bottom flange;

said back perpendicular leg being attached to said fourth rail; and said back left support and said back right support being attached to said back parallel leg.

4. Said wireless tire deflation device launcher as claimed in claim 2 comprises of, said left spring rod being connected to said middle support connection beam;

said left spring rod being connected to said back support connection beam;

said left spring rod being encircled by said left spring;

said right spring rod being connected to said middle support connection beam;

said right spring rod being connected to said back support connection beam;

said right spring rod being encircled by said right spring; and said forward stop cushion being located on said middle support connection beam.

5. Said wireless tire deflation device launcher as claimed in claim 3 comprises of, said left spring rod being attached to said middle web;

said left spring rod being attached to said back perpendicular leg;

said right spring rod being attached to said middle web;

said right spring rod being attached to said back perpendicular leg;

said forward stop cushion being located in between said top flange and said bottom flange; and said forward stop cushion being located in between said left spring rod and said right spring rod.

6. Said wireless tire deflation device launcher as claimed in claim 2 comprises of, said guide rail being encircled by said rail housing;

said seat being connected atop to said rail housing;

said handle being connected to said seat;

said T-beam being attached below to said rail housing;

said left spring rod hole being traversed by said left spring rod;

said right spring rod hole being traversed by said right spring rod;

said left spring being positioned between back flange and back support connection beam; and said right spring being positioned between back flange and back support connection beam.

7. Said wireless tire deflation device launcher as claimed in claim 3 comprises of, said left spring being positioned between said back flange and said perpendicular back leg; and said right spring positioned between said back flange and said perpendicular back leg.

8. Said wireless tire deflation device launcher as claimed in claim 2 comprises of, said trigger protrusion being adhered to back support connection bar;

said trigger protrusion being positioned between said top panel and said bottom panel;

said top panel, said bottom panel, and said trigger protrusion being interconnected by said plurality of fasteners;

a space in between said top panel and said bottom panel created by said trigger protrusion being maintained by said plurality of spacers;

said plurality of spacers being held in place by said plurality of fasteners;

said motor base being attached to said bottom panel by said plurality of fasteners;

said motor being connected to said worm gear;

said reduction gear being engaged by said worm gear;

said motor, said worm gear, and said reduction plate being housed by said motor housing;

said motor housing being attached to said motor base by said plurality of fasteners;

said rotator plate being adhered atop said reduction gear;

said extension arm being jointly attached to said rotator plate;

said extension arm being jointly attached to said cam;

said cam being jointly attached to said spring loaded lock;

said spring loaded lock being positioned in between said top panel and said bottom panel;

said trigger cavity being engaged by said spring loaded lock;

said push train being secured by said spring loaded lock; and said radio receiver electrically connected to said motor.

9. A wireless tire deflation device launcher comprises of, a guide frame;

an energy storing mechanism;

a push train;

a wireless trigger mechanism;

said guide frame comprises of a guide rail, a guide support, and a device support;

said energy storing mechanism consists of a left spring rod, a left spring, a right spring rod, a right spring, and a forward stop cushion;

said push train comprises of a handle, a seat, a rail housing, a backward stop protrusion, a ramp protrusion, and a T-beam;

said T-beam comprises of a back flange, a left spring rod hole, a right spring rod hole, and a front web;

said wireless trigger mechanism comprises of a trigger protrusion, a top panel, a bottom panel, a plurality of spacers, a plurality of fasteners, a motor base, a motor housing, a motor, a worm gear, a reduction gear, a rotator plate, an extension arm, a cam, a spring loaded lock, a radio receiver, a radio signal, and a remote;

said guide rail comprises of a first rail, a second rail, a third rail, a fourth rail, a first connection, a second connection, and a third connection;

said guide support comprises of a front left support, a front right support, a front support connection beam, a middle left support, a middle right support, a middle support connection beam, a back left support, a back right support, and a back support connection beam;

said device support comprises of a device surface, a device left arm, a device left hand, a device right arm, and a device right hand;

said first rail being attached to said second rail by said first connection;

said second rail being attached to said third rail by said second connection;

said third rail being attached to said fourth rail by said third connection;

said front left support and said front right support being connected to said first rail by said front support connection beam;

said middle left support and said middle right support being connected to said third connection by said middle support connection beam;

said back left support and said back right support being connected to said fourth rail by said back support connection beam;

said device left arm being attached to said middle support connection beam;

said device right arm being attached to said middle support connection beam;

said device left hand being connected to said device left arm; and said device right hand being connected to said device right arm.

10. Said wireless tire deflation device launcher as claimed in claim 9 comprises of, said front support connection beam comprises of a front perpendicular leg and a front parallel leg;

said middle support connection beam comprises of a top flange, a middle web, and a bottom flange;

said back support connection beam comprises of a back perpendicular leg and a back parallel leg;

said front perpendicular leg being attached to said first rail;

said front left support and said front right support being attached to said front parallel leg;

said top flange being attached to said third connection;

said middle left support and said middle right support being attached to said bottom flange;

said back perpendicular leg being attached to said fourth rail;

said back left support and said back right support being attached to said back parallel leg;

said left spring rod being attached to said middle web;

said left spring rod being attached to said back perpendicular leg;

said right spring rod being attached to said middle web;

said right spring rod being attached to said back perpendicular leg;

said forward stop cushion being located in between said top flange and said bottom flange; and said forward stop cushion being located in between said left spring rod and said right spring rod.

11. Said wireless tire deflation device launcher as claimed in claim 10 comprises of, said left spring being positioned between said back flange and said perpendicular back leg; and said right spring positioned between said back flange and said perpendicular back leg.

12. Said wireless tire deflation device launcher as claimed in claim 9 comprises of, said left spring rod being connected to said middle support connection beam;

said left spring rod being connected to said back support connection beam;

said left spring rod being encircled by said left spring;

said right spring rod being connected to said middle support connection beam;

said right spring rod being connected to said back support connection beam;

said right spring rod being encircled by said right spring; and said forward stop cushion being located on said middle support connection beam.

13. Said wireless tire deflation device launcher as claimed in claim 9 comprises of, said guide rail being encircled by said rail housing;

said seat being connected atop to said rail housing;

said handle being connected to said seat;

said T-beam being attached below to said rail housing;

said left spring rod hole being traversed by said left spring rod;

said right spring rod hole being traversed by said right spring rod;

said left spring being positioned between back flange and back support connection beam; and said right spring being positioned between back flange and back support connection beam.

14. Said wireless tire deflation device launcher as claimed in claim 9 comprises of, said trigger protrusion being adhered to back support connection bar;

said trigger protrusion being positioned between said top panel and said bottom panel;

said top panel, said bottom panel, and said trigger protrusion being interconnected by said plurality of fasteners;

a space in between said top panel and said bottom panel created by said trigger protrusion being maintained by said plurality of spacers;

said plurality of spacers being held in place by said plurality of fasteners;

said motor base being attached to said bottom panel by said plurality of fasteners;

said motor being connected to said worm gear;

said reduction gear being engaged by said worm gear;

said motor, said worm gear, and said reduction plate being housed by said motor housing;

said motor housing being attached to said motor base by said plurality of fasteners;

said rotator plate being adhered atop said reduction gear;

said extension arm being jointly attached to said rotator plate;

said extension arm being jointly attached to said cam;

said cam being jointly attached to said spring loaded lock;

said spring loaded lock being positioned in between said top panel and said bottom panel;

said trigger cavity being engaged by said spring loaded lock;

said push train being secured by said spring loaded lock; and said radio receiver electrically connected to said motor.

15. A wireless tire deflation device launcher comprises of, a guide frame;

an energy storing mechanism;

a push train;

a wireless trigger mechanism;

said guide frame comprises of a guide rail, a guide support, and a device support;

said energy storing mechanism consists of a left spring rod, a left spring, a right spring rod, a right spring, and a forward stop cushion;

said push train comprises of a handle, a seat, a rail housing, a backward stop protrusion, a ramp protrusion, and a T-beam;

said T-beam comprises of a back flange, a left spring rod hole, a right spring rod hole, and a front web;

said wireless trigger mechanism comprises of a trigger protrusion, a top panel, a bottom panel, a plurality of spacers, a plurality of fasteners, a motor base, a motor housing, a motor, a worm gear, a reduction gear, a rotator plate, an extension arm, a cam, a spring loaded lock, a radio receiver, a radio signal, and a remote;

said guide rail comprises of a first rail, a second rail, a third rail, a fourth rail, a first connection, a second connection, and a third connection;

said guide support comprises of a front left support, a front right support, a front support connection beam, a middle left support, a middle right support, a middle support connection beam, a back left support, a back right support, and a back support connection beam;

said device support comprises of a device surface, a device left arm, a device left hand, a device right arm, and a device right hand;

said first rail being attached to said second rail by said first connection;

said second rail being attached to said third rail by said second connection;

said third rail being attached to said fourth rail by said third connection;

said front left support and said front right support being connected to said first rail by said front support connection beam;

said middle left support and said middle right support being connected to said third connection by said middle support connection beam;

said back left support and said back right support being connected to said fourth rail by said back support connection beam;

said device left arm being attached to said middle support connection beam;

said device right arm being attached to said middle support connection beam;

said device left hand being connected to said device left arm;

said device right hand being connected to said device right arm;

said left spring rod being connected to said middle support connection beam;

said left spring rod being connected to said back support connection beam;

said left spring rod being encircled by said left spring;

said right spring rod being connected to said middle support connection beam;

said right spring rod being connected to said back support connection beam;

said right spring rod being encircled by said right spring;

said guide rail being encircled by said rail housing; and said seat being connected atop to said rail housing.

16. Said wireless tire deflation device launcher as claimed in claim 15 comprises of, said forward stop cushion being located on said middle support connection beam.

17. Said wireless tire deflation device launcher as claimed in claim 15 comprises of, said handle being connected to said seat;

said T-beam being attached below to said rail housing;

said left spring rod hole being traversed by said left spring rod;

said right spring rod hole being traversed by said right spring rod;

said left spring being positioned between back flange and back support connection beam; and said right spring being positioned between back flange and back support connection beam.

18. Said wireless tire deflation device launcher as claimed in claim 15 comprises of, said trigger protrusion being adhered to back support connection bar;

said trigger protrusion being positioned between said top panel and said bottom panel;

said top panel, said bottom panel, and said trigger protrusion being interconnected by said plurality of fasteners;

a space in between said top panel and said bottom panel created by said trigger protrusion being maintained by said plurality of spacers;

said plurality of spacers being held in place by said plurality of fasteners;

said motor base being attached to said bottom panel by said plurality of fasteners;

said motor being connected to said worm gear;

said reduction gear being engaged by said worm gear;

said motor, said worm gear, and said reduction plate being housed by said motor housing;

said motor housing being attached to said motor base by said plurality of fasteners;

said rotator plate being adhered atop said reduction gear;

said extension arm being jointly attached to said rotator plate;

said extension arm being jointly attached to said cam;

said cam being jointly attached to said spring loaded lock;

said spring loaded lock being positioned in between said top panel and said bottom panel;

said trigger cavity being engaged by said spring loaded lock;

said push train being secured by said spring loaded lock; and said radio receiver electrically connected to said motor.

19. Said wireless tire deflation device launcher as claimed in claim 15 comprises of, said front support connection beam comprises of a front perpendicular leg and a front parallel leg;

said middle support connection beam comprises of a top flange, a middle web, and a bottom flange;

said back support connection beam comprises of a back perpendicular leg and a back parallel leg;

said front perpendicular leg being attached to said first rail;

said front left support and said front right support being attached to said front parallel leg;

said top flange being attached to said third connection;

said middle left support and said middle right support being attached to said bottom flange;

said back perpendicular leg being attached to said fourth rail;

said back left support and said back right support being attached to said back parallel leg;

said left spring rod being attached to said middle web;

said left spring rod being attached to said back perpendicular leg;

said right spring rod being attached to said middle web;

said right spring rod being attached to said back perpendicular leg;

said forward stop cushion being located in between said top flange and said bottom flange;

said forward stop cushion being located in between said left spring rod and said right spring rod;

said left spring being positioned between said back flange and said perpendicular back leg; and said right spring positioned between said back flange and said perpendicular back leg.

* * * * *